US011289018B2

(12) United States Patent
Kim et al.

(10) Patent No.: US 11,289,018 B2
(45) Date of Patent: Mar. 29, 2022

(54) DISPLAY DEVICE AND DRIVING METHOD THEREOF

(71) Applicant: Samsung Display Co., Ltd., Yongin-si (KR)

(72) Inventors: Kyun Ho Kim, Yongin-si (KR); Yong-Jin Shin, Asan-si (KR); Seong Jun Kim, Seoul (KR); Jung-Taek Kim, Seoul (KR); Joon Suk Baik, Suwon-si (KR); Se Keun Lee, Hwaseong-si (KR); Uk Jae Jang, Gongju-si (KR); Sang Su Han, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/065,418

(22) Filed: Oct. 7, 2020

(65) Prior Publication Data

US 2021/0201781 A1 Jul. 1, 2021

(30) Foreign Application Priority Data

Dec. 30, 2019 (KR) ..... 10-2019-0178170

(51) Int. Cl.
*G09G 3/3233* (2016.01)
*G09G 3/3275* (2016.01)

(52) U.S. Cl.
CPC ..... *G09G 3/3233* (2013.01); *G09G 3/3275* (2013.01); *G09G 2320/04* (2013.01);
(Continued)

(58) Field of Classification Search
CPC .... G09G 3/006; G09G 3/3233; G09G 3/3275; G09G 3/3677; G09G 2330/025; G09G 2330/04; G09G 2330/08; G09G 2330/021; G09G 2330/027; G09G 2330/00; G09G 2330/12; G09G 2330/028; G09G 2360/16; G09G 2360/08; G09G 2300/043; G09G 2320/04; G09G 3/3225; G09G 3/3258; G09G 3/3283; G09G 3/3291; G09G 3/3696; G09G 2300/0866; G09G 2320/0285;
(Continued)

(56) References Cited

U.S. PATENT DOCUMENTS

2015/0229117 A1* 8/2015 Kim ..... H02H 3/08 345/212
2017/0192065 A1* 7/2017 Lee ..... G09G 3/3283
2020/0251045 A1* 8/2020 An ..... H02H 1/0007

FOREIGN PATENT DOCUMENTS

KR 10-1389498 4/2014
KR 10-2014-0141276 A 12/2014
(Continued)

*Primary Examiner* — Nitin Patel
*Assistant Examiner* — Amen W Bogale
(74) *Attorney, Agent, or Firm* — Lewis Roca Rothgerber Christie LLP

(57) ABSTRACT

A display device includes: a net power control circuit configured to analyze a screen load from an input image signal to generate a load signal including a load value corresponding to the screen load; and an overcurrent protection circuit configured to set a set current value at a predetermined ratio with respect to a global current value corresponding to the load value included in the load signal, and to determine whether or not the display device is powered off based on the set current value.

20 Claims, 7 Drawing Sheets

| | Screen load | LOAD | GCM | OCP first set current value (20 % margin) |
|---|---|---|---|---|
| | 1 % | 1 % | 1 A | 2 A (predetermined) |
| | 10 % | 10 % | 10 A | 12 A |
| | 20 % | 20 % | 20 A | 24 A |
| Reference load | 30 % | 30 % | 30 A | 36 A |
| | 40 % | 30 % | 30 A | 36 A |
| | 50 % | 30 % | 30 A | 36 A |
| | over | 30 % | 30 A | 36 A |

(52) U.S. Cl.
CPC ... *G09G 2330/025* (2013.01); *G09G 2330/04* (2013.01); *G09G 2330/08* (2013.01)

(58) Field of Classification Search
CPC ... G09G 2320/0233; G09G 2320/0626; G09G 2320/0613; G09G 2330/02; G06F 1/28; G01R 31/44; G01R 31/50; G01R 31/52; G01R 31/54; G01R 31/55; G01R 31/56; H02H 3/08; H02H 7/008; H02H 1/007; H01H 2213/014
See application file for complete search history.

(56) References Cited

FOREIGN PATENT DOCUMENTS

| | | | |
|---|---|---|---|
| KR | 10-2018-0118855 | A | 11/2018 |
| KR | 10-2019-0055873 | A | 5/2019 |

* cited by examiner

FIG. 2

| | Screen load | LOAD | GCM | OCP first set current value (20 % margin) |
|---|---|---|---|---|
| | 1 % | 1 % | 1 A | 2 A (predetermined) |
| | 10 % | 10 % | 10 A | 12 A |
| | 20 % | 20 % | 20 A | 24 A |
| Reference load | 30 % | 30 % | 30 A | 36 A |
| | 40 % | 30 % | 30 A | 36 A |
| | 50 % | 30 % | 30 A | 36 A |
| | over | 30 % | 30 A | 36 A |

FIG. 3

| | Screen load | LOAD | GCM | OCP second set current value (20 % margin) |
|---|---|---|---|---|
| | 1 % | 1 % | 1 A | 3 A (predetermined) |
| | 10 % | 10 % | 10 A | 12.5 A |
| | 20 % | 20 % | 20 A | 25 A |
| Reference load | 30 % | 30 % | 30 A | 37.5 A |
| | 40 % | 30 % | 30 A | 37.5 A |
| | 50 % | 30 % | 30 A | 37.5 A |
| | over | 30 % | 30 A | 37.5 A |

FIG. 4

| | Screen load | LOAD | GCM | OCP third set current value (20 % margin) |
|---|---|---|---|---|
| | 1 % | 1 % | 1 A | 4 A (predetermined) |
| | 10 % | 10 % | 10 A | 13 A |
| | 20 % | 20 % | 20 A | 26 A |
| Reference load | 30 % | 30 % | 30 A | 39 A |
| | 40 % | 30 % | 30 A | 39 A |
| | 50 % | 30 % | 30 A | 39 A |
| | over | 30 % | 30 A | 39 A |

FIG. 5

| Screen load | OCP first black set current value | OCP second black set current value | OCP third black set current value |
|---|---|---|---|
| Black | 0.1 A | 0.2 A | 0.3 A |

DISPLAY DEVICE AND DRIVING METHOD THEREOF

CROSS-REFERENCE TO RELATED APPLICATION

The present application claims priority to and the benefit of Korean Patent Application No. 10-2019-0178170 filed in the Korean Intellectual Property Office on Dec. 30, 2019, the entire contents of which are incorporated herein by reference.

BACKGROUND

1. Field

Aspects of some example embodiments of the present invention relates to a display device and a driving method thereof.

2. Description of the Related Art

Recently, organic light emitting diode displays have attracted attention as a device for displaying an image.

The organic light emitting diode display uses an organic light emitting diode that generates light by recoupling electrons and holes to display an image. Because the organic light emitting diode display has a self-emission characteristic and does not require an additional light source, unlike a liquid crystal display device, it may be possible to reduce thickness and weight thereof. Further, the organic light emitting diode display has high-quality characteristics such as relatively low power consumption, relatively high luminance, and relatively high response speed.

The organic light emitting diode is driven by using a data voltage according to an image data signal, and a power voltage applied to an anode and a cathode. A power supply line to which the power voltage is applied may be shorted to another wire such as a data line to which the data voltage is applied. In this case, an overcurrent may occur between a power supply part and a display part, and the organic light emitting diode and the like may be degraded due to the overcurrent so that the organic light emitting diode display may be damaged.

In order to prevent the organic light emitting diode display from being damaged due to the overcurrent, an overcurrent protection circuit for detecting a current flowing in the power line and shutting down the power supply part may be used. The overcurrent protection circuit shuts down the power supply when an overcurrent occurs to be greater than a set current value thereof. However, because the set current value of the overcurrent protection circuit is set to 1.2 times a maximum current that may flow in the display part, the overcurrent protection circuit does not actually operate in many cases.

When the maximum current that may flow in the display part is 30 A, the set current value of the overcurrent protection circuit is set to 36 A. When a blue image is displayed, a current of about 10 A flows in the display part, when a red image is displayed, a current of about 15 A flows in the display part, when a green image is displayed, a current of about 18 A flows in the display part, and when a white image is displayed, a current of about 30 A flows in the display portion. Even when a short circuit occurs in a portion of the display portion, because a current is low excluding a case in which the white image is displayed, the overcurrent protection circuit does not operate because a current flows at 25 A or less even when the overcurrent flows. In this case, the overcurrent may continuously flow in the organic light emitting diodes of a portion of the display, and thus the organic light emitting diodes may deteriorate.

The above information disclosed in this Background section is only for enhancement of understanding of the background of the invention and therefore it may contain information that does not constitute prior art.

SUMMARY

Aspects of some example embodiments of the present invention relate to a display device and a driving method thereof, and for example, to a display device provided with an overcurrent protection circuit and a driving method thereof.

Aspects of some example embodiments of the present invention include a display device in which an overcurrent protection circuit may adaptively operate to a screen load of the display device, and a driving method thereof.

According to some example embodiments of the present invention, a display device includes: a net power control circuit that analyzes a screen load from an input image signal to generate a load signal including a load value corresponding to the screen load; and an overcurrent protection circuit that sets a set current value at a predetermined ratio with respect to a global current value corresponding to the load value included in the load signal, and determines whether the display device is powered off by using the set current value.

According to some example embodiments, the overcurrent protection circuit may set the set current value to a predetermined value rather than through the predetermined ratio with respect to the global current value when the global current value is 1 A or less.

According to some example embodiments, the load value may increase as the screen load increases up to a reference load, and when the screen load is the reference load or more, the load value may be set to the reference load, and the global current value may increase as the screen load increases up to the reference load, and when the screen load is the reference load or more, the global current value may be set to the global current value corresponding to the reference load.

According to some example embodiments, the display device may further include a global current modulation circuit that selects the global current value corresponding to the load value included in the load signal, and generates a global current signal including a difference between the global current of the power voltage supplied to a display portion and the global current value.

According to some example embodiments, the display device may further include a plurality of pixels included the display portion; a power supply supplying a power voltage for driving the plurality of pixels to the display portion; a data driver applying a data voltage to the plurality of pixels; and a signal controller that receives the input image signal, generates an image data signal by applying the load value and the global current value to the input image signal, and applies the image data signal to the data driver.

According to some example embodiments, the overcurrent protection circuit may receive a global current of a power voltage supplied to the display portion and may generate a power line error signal when the global current is greater than the set current value, and the signal controller may control the data driver to display a black image on the display portion when the power line error signal is received.

According to some example embodiments, the overcurrent protection circuit may receive a global current of the black image when the black image is displayed on the display portion, and may shut down the power supply when the global current of the black image is greater than a black set current value.

According to some example embodiments, the overcurrent protection circuit may set the set current value to one of a first set current value that is 20% higher than the global current value, a second set current value that is 25% higher than the global current value, and a third set current value that is 30% higher than the global current value.

According to some example embodiments, when the black image is displayed on the display portion, the overcurrent protection circuit may receive the global current of the black image, and when the global current of the black image is not greater than the black set current value, the overcurrent protection circuit may increase the set current value to the second set current value or the third set current value.

According to some example embodiments, the overcurrent protection circuit may shut down the power supply when the set current value is not increased.

According to some example embodiments of the present invention, a driving method of a display device includes: analyzing a screen load from an input image signal; selecting a load value corresponding to the screen load; selecting a global current value corresponding to the selected load value; and setting a set current value of an overcurrent protection circuit corresponding to the selected load value, wherein whether the display device is powered off may be determined by using the set current value.

According to some example embodiments, the set current value of the overcurrent protection circuit may be set at a predetermined ratio with respect to the selected global current value.

According to some example embodiments, the set current value of the overcurrent protection circuit may be set to a value that is 20% to 30% higher than the selected global current value.

According to some example embodiments, when the selected global current value is 1 A or less, the set current value of the overcurrent protection circuit may be set to a predetermined value rather than through a predetermined ratio with respect to the selected global current value.

According to some example embodiments, the load value may increase as the screen load increases up to a reference load, and when the screen load is equal to or greater than the reference load, the load value may be set to the reference load, while the global current value may increase as the screen load increases up to the reference load, and when the screen load is greater than or equal to the reference load, the global current value may be set to the global current value corresponding to the reference load.

According to some example embodiments, the driving method of the display device may further include: receiving the global current; comparing the global current with the set current value; and displaying a black image when the global current is greater than the set current value.

According to some example embodiments, the driving method of the display device may further include: receiving a global current of the black image; comparing the global current of the black image with a black set current value; and powering off the display device when the global current of the black image is greater than the black set current value.

According to some example embodiments, the driving method of the display device may further include: determining whether the set current value of the overcurrent protection circuit is able to be increased when the global current of the black image is not greater than the black set current value; and when the set current value of the overcurrent protection circuit is able to be increased, increasing the set current value of the overcurrent protection circuit and re-driving the display device.

According to some example embodiments, the set current value of the overcurrent protection circuit may be set to a value that is 20% higher than the global current value, and may increase to a value that is 25% higher than the global current value or to a value that is 30% higher than the global current value.

According to some example embodiments, the driving method of the display device may further include powering off the display device when the set current value of the overcurrent protection circuit is not able to be increased.

According to some example embodiments, the overcurrent protection circuit may be operated adaptively according to the screen load of the display device, and the overcurrent protection circuit may operate even at a low screen load to prevent or reduce degradation of the organic light emitting diode.

BRIEF DESCRIPTION OF THE DRAWINGS

FIG. 2 illustrates a lookup table for setting a first set current of an overcurrent protection circuit according to some example embodiments of the present invention.

FIG. 3 illustrates a lookup table for setting a second set current of an overcurrent protection circuit according to some example embodiments of the present invention.

FIG. 4 illustrates a lookup table for setting a third set current of an overcurrent protection circuit according to some example embodiments of the present invention.

FIG. 5 illustrates a lookup table for setting a black set current of an overcurrent protection circuit according to some example embodiments of the present invention.

DETAILED DESCRIPTION

Figure 1:
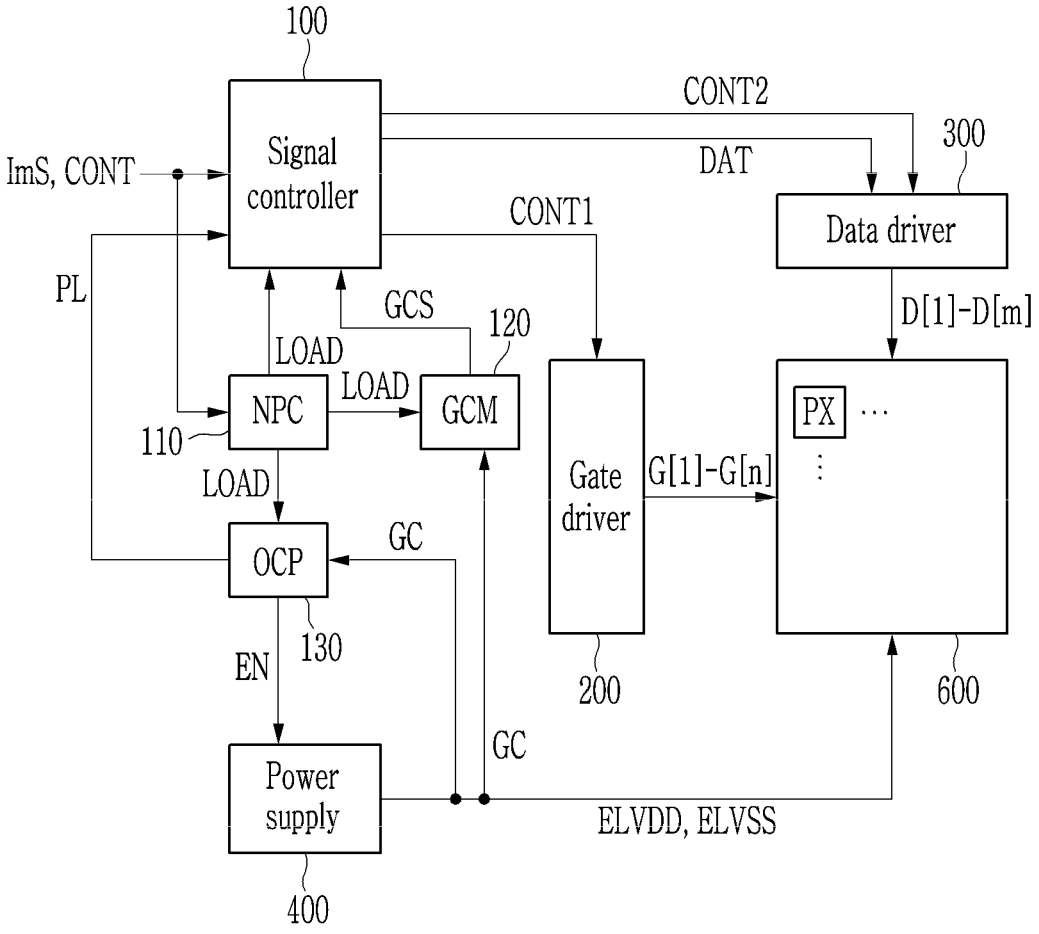
FIG. 1 illustrates a block diagram of a display device according to some example embodiments of the present invention.

Aspects of some example embodiments of the present invention will be described more fully hereinafter with reference to the accompanying drawings, in which aspects of some example embodiments of the invention are shown. As those skilled in the art would realize, the described embodiments may be modified in various different ways, all without departing from the spirit or scope of embodiments according to the present disclosure.

Furthermore, with example embodiments of the present invention, detailed description is made as to the constituent elements in the first embodiment with reference to the relevant drawings by using the same reference numerals for the same constituent elements, while only different constituent elements from those related to the first embodiment are described in other embodiments.

Parts that are irrelevant to the description will be omitted to clearly describe the present disclosure, and like reference numerals designate like elements throughout the specification.

In the present specification, unless explicitly described to the contrary, the word "comprise" and variations such as "comprises" or "comprising" will be understood to imply the inclusion of stated elements but not the exclusion of any other elements.

Hereinafter, a display device according to some example embodiments of the present invention will be described in more detail with reference to FIG. 1 to FIG. 5.

FIG. 1 illustrates a block diagram of a display device according to some example embodiments of the present invention. FIG. 2 illustrates a lookup table for setting a first set current of an overcurrent protection circuit according to some example embodiments of the present invention. FIG. 3 illustrates a lookup table for setting a second set current of an overcurrent protection circuit according to some example embodiments of the present invention. FIG. 4 illustrates a lookup table for setting a third set current of an overcurrent protection circuit according to some example embodiments of the present invention. FIG. 5 illustrates a lookup table for setting a black set current of an overcurrent protection circuit according to some example embodiments of the present invention.

Referring to FIG. 1 to FIG. 5, the display device includes a signal controller 100, a net power control (NPC) circuit 110, a global current modulation (GCM) circuit 120, an overcurrent protection (OCP) circuit 130, a gate driver 200, a data driver 300, a power supply 400, and a display portion 600.

Herein, it is illustrated that the net power control circuit 110, the global current modulation circuit 120, and the overcurrent protection circuit 130 are separately provided from the signal controller 100, but the net power control circuit 110, the global current modulation circuit 120, and the overcurrent protection circuit 130 may be included in the signal controller 100.

The signal controller 100 receives an input image signal ImS and a synchronization signal CONT inputted from an external device or external source. The input image signal ImS includes luminance information of a plurality of pixels PX. Luminance has a predetermined number of gray levels. The synchronization signal CONT may include a horizontal synchronizing signal, a vertical synchronization signal, and main clock signal.

The signal controller 100 generates a first driving control signal CONT1, a second driving control signal CONT2, and an image data signal DAT according to or based on the input image signal ImS and the synchronization signal CONT. The signal controller 100 may classify the input image signal ImS in a frame unit according to or based on the vertical synchronization signal, and it may classify the input image signal ImS in a gate line unit according to or based on the horizontal synchronization signal to generate the image data signal DAT.

In addition, the signal controller 100 may receive a load signal LOAD from the net power control circuit 110 and receive a global current signal GCS from the global current modulation circuit 120. The signal controller 100 may generate the image data signal DAT by applying a load value included in the load signal LOAD to the input image signal ImS. The signal controller 100 may generate the image data signal DAT by applying a global current value included in the global current signal GCS to the input image signal ImS. The signal controller 100 may adjust a level of the image data signal DAT according to or based on the load value and the global current value.

The signal controller 100 transmits the first driving control signal CONT1 to the gate driver 200. The signal controller 100 transmits the image data signal DAT and the second driving control signal CONT2 to the data driver 300.

The display portion 600 includes a plurality of pixels PX to display an image. An area in which a plurality of pixels PX are arranged to display an image is referred to as a display area or a screen. The display portion 600 includes a plurality of scan lines connected to the plurality of pixels PX, and a plurality of data lines connected to the plurality of pixels PX. The plurality of scan lines may substantially extend in a row direction such that they are substantially parallel to each other. The plurality of data lines may substantially extend in a column direction such that they are substantially parallel to each other. The plurality of pixels PX may be arranged in an area in which the plurality of scan lines and the plurality of data lines cross each other. According to a structure of the plurality of pixels PX included in the display portion 600, the signal lines included in the display portion 600 may be variously changed. For example, the display portion 600 may further include a plurality of sensing lines extending in the row direction, a plurality of light emitting lines extending in the row direction, a plurality of receiving lines extending in the column direction, and the like. A configuration of the display portion 600 is not limited.

The gate driver 200 is connected to the plurality of gate lines. The gate driver 200 generates a plurality of scan signals G[1] to G[n] according to the first driving control signal CONT1. The plurality of scan signals G[1] to G[n] include a combination of a gate-on voltage and a gate-off voltage. The gate driver 200 may sequentially apply the scan signals G[1] to G[n] having the gate-on voltage to the plurality of gate lines.

The data driver 300 is connected to the plurality of data lines, samples and holds the image data signal DAT according to the second driving control signal CONT2, and applies the plurality of data signals D[1] to D[m] to the plurality of data lines. The data driver 300 corresponds to the scan signals G[1] to G[n] having the gate-on voltage to apply the data voltage D[1] to D[m] having a voltage range (e.g., a set or predetermined voltage range) on the data lines.

The power supply 400 generates power voltages ELVDD and ELVSS. The power voltages ELVDD and ELVSS include a first power voltage ELVDD and a second power voltage ELVSS. The first power voltage ELVDD and the second power voltage ELVSS are applied to the plurality of pixels PX included in the display portion 600. The first power voltage ELVDD and the second power voltage ELVSS are voltages for driving the plurality of pixels PX. The first power voltage ELVDD is a high level voltage that is higher than the second power voltage ELVSS, and may provide a current to the anodes of the plurality of pixels PX. The second power voltage ELVSS is a low level voltage that is lower than the first power voltage ELVDD, and it may be applied to the cathodes of the plurality of pixels PX.

The net power control circuit 110 receives the input image signal ImS. The net power control circuit 110 analyzes a screen load from the input image signal ImS. The screen load may be a ratio of a portion in which an image is displayed according to the input image signal ImS with respect to an entire screen. The net power control circuit 110 generates the load signal LOAD including a load value corresponding to the screen load. The load value included in the load signal LOAD increases as the screen load increases up to a reference load. When the screen load is greater than or equal to the reference load, the load value included in the load signal LOAD is set to the reference load.

As illustrated in FIGS. 2 to 4, the reference load may be 30%. When the screen load is 1% to 30%, the load value included in the load signal LOAD is set to 1 to 30% corresponding to the screen load. When the screen load is greater than or equal to 30%, which is the reference load, the load value included in the load signal LOAD is set to 30%.

The net power control circuit 110 transmits the load signal LOAD to the signal controller 100, the global current modulation circuit 120, and the overcurrent protection circuit 130.

The signal controller 100 may adjust the level of the image data signal DAT according to the load value included in the load signal LOAD. When the screen load is 1%, the signal controller 100 may adjust the level of the image data signal DAT so that a luminance of a maximum gray image (for example, a white image) may be 500 nit, and a current of 1 A may flow in the display portion 600. When the screen load is 30%, the signal controller 100 may adjust the level of the image data signal DAT so that the luminance of the image having the maximum gray may by 150 nit, and a current of 30 A may flow in the display portion 600. The maximum current that may flow in the display portion 600 may be 30 A based on the luminance of 150 nit when the image having the maximum gray is displayed. Even when the screen load is 30% or more, which is the reference load, since the load value is set to 30%, it may be controlled so that a larger current than a maximum current does not flow in the display portion 600.

That is, the net power control circuit 110 allows the luminance of the image to be adjusted according to or based on the screen load. In addition, the net power control circuit 110 may serve to prevent or reduce instances of the current flowing in the display portion 600 exceeding the maximum current under a reference load or more.

The global current modulation circuit 120 selects a global current value corresponding to the load value included in the load signal LOAD. As illustrated in FIG. 2 to FIG. 4, the global current modulation circuit 120 may select global current values of 1 A, 10 A, 20 A, and 30 A in response to load values of 1%, 10%, 20%, and 30%.

The global current modulation circuit 120 receives a global current GC of the power voltages ELVDD and ELVSS supplied to the display portion 600. The global current modulation circuit 120 generates the global current signal GCS including a difference between the global current GC and the global current value. The global current modulation circuit 120 transmits the global current signal GCS to the signal controller 100.

The signal controller 100 may receive the global current signal GCS and adjust a level of the image data signal DAT so that the difference between the global current GC and the global current value may be reduced.

That is, the global current modulation circuit 120 may serve to control the constant current so that the global current GC flowing in the display portion 600 may become a constant current according to the screen load. Since the net power control circuit 110 serves to allow the level of the image data signal DAT to be adjusted according to the screen load regardless of the global current GC flowing in the display portion 600, the luminance of the image is rapidly changed due to a temperature change and the like. Because the global current modulation circuit 120 controls the global current GC flowing in the display portion 600 to be the constant current control according to the screen load, the luminance of the image may not be rapidly changed.

The overcurrent protection circuit 130 sets a set current value according to or based on the load value included in the load signal LOAD. The overcurrent protection circuit 130 may set the set current value at a ration (e.g., a set or predetermined ratio) with respect to the global current value corresponding to the load value included in the load signal LOAD. The set current value is a reference for determining whether the display device is powered off. The overcurrent protection circuit 130 may include lookup tables illustrated in FIG. 2 to FIG. 5 to set the set current value.

The overcurrent protection circuit 130 may set a first set current value having a 20% margin with respect to the global current value corresponding to the load value by using the lookup table of FIG. 2. That is, the overcurrent protection circuit 130 may set the set current value to the first set current value that is 20% higher than the global current value.

The overcurrent protection circuit 130 may set a second set current value having a 25% margin with respect to the global current value corresponding to the load value by using the lookup table of FIG. 3. That is, the overcurrent protection circuit 130 may set the set current value to the second set current value that is 25% higher than the global current value.

The overcurrent protection circuit 130 may set a third set current value having a 30% margin with respect to the global current value corresponding to the load value by using the lookup table of FIG. 4. That is, the overcurrent protection circuit 130 may set the set current value to the third set current value that is 30% higher than the global current value.

However, when the global current value is 1 A or less, the overcurrent protection circuit 130 may set the set current value to a value (e.g., a set or predetermined value) rather than through a ratio (e.g., a set or predetermined ratio) with respect to the global current value. That is, when the load value is 1% or less, the overcurrent protection circuit 130 may set the set current value to a value (e.g., a set or predetermined value) rather than through a ratio (e.g., a set or predetermined ratio) with respect to the global current value. As illustrated in FIG. 2 to FIG. 4, for the global current value of 1 A, the first set current value may be set to 2 A, the second set current value may be set to 3 A, and the third set current value may be set to 4 A. Current values that are 20% to 30% higher than the global current values of 1 A or less may be 1.2 A, 1.25 A, 1.3 A, etc., and the overcurrent may be relatively easily determined because differences between these current values and the global current values are relatively small. This problem may be avoided when the set current value is set to a value specified to the global current value of 1 A or less.

The overcurrent protection circuit 130 may calculate the global current value and the set current value in an interval between the load values of the lookup tables of FIG. 2 to FIG. 4 by an interpolation method.

The overcurrent protection circuit 130 receives the global current GC of the power voltages ELVDD and ELVSS supplied to the display portion 600, and performs a process of powering off the display device when the global current GC is greater than the set current value. The power-off of the display device is not only determined by one process of comparing the global current GC and the set current value. The overcurrent protection circuit 130 may further perform a process of comparing a global current GC of a black image with a set current value for the black image, a process of increasing the set current value, and the like, to determine the power-off of the display device.

The overcurrent protection circuit 130 receives the global current GC of the power voltages ELVDD and ELVSS supplied to the display portion 600, and generates a power line error signal PL when the global current GC is greater than the set current value. The overcurrent protection circuit 130 transmits the power line error signal PL to the signal controller 100.

When the signal controller 100 receives the power line error signal PL, it allows the black image to be displayed on the display portion 600. The signal controller 100 may generate the image data signal DAT for displaying the black image, and control the gate driver 200 and the data driver 300.

The overcurrent protection circuit 130 may set the set current value for the black image to one of a first black set current value, a second black set current value, and a third black set current value by using a lookup table of FIG. 5. The first black set current value may be 0.1 A, the second black set current value may be 0.2 A, and the third black set current value may be 0.3 A. When the overcurrent protection circuit 130 generates the power line error signal PL at a first time, the set current value for the black image may be set to the first black set current value.

The overcurrent protection circuit 130 may adjust a detection time for measuring the global current GC. After transmitting the power line error signal PL to the signal controller 100, the overcurrent protection circuit 130 receives the global current GC of the black image after a predetermined time, and compares the global current of the black image with the black set current value. This is to measure the global current GC after the black image is displayed on the display portion 600 and the global current GC for the black image is generated.

The overcurrent protection circuit 130 may adjust a change time of the set current value according to a change of the screen load. This is to prevent or reduce instances of the set current value of the overcurrent protection circuit 130 being changed faster than the global current value is set according to the changed screen load.

The overcurrent protection circuit 130 receives the global current GC of the black image when the black image is displayed on the display portion 600, and compares the global current GC of the black image with the first black set current value.

When the global current GC of the black image is greater than the first black set current value, the overcurrent protection circuit 130 shuts down the power supply 400 to turn off the power of the display device. The overcurrent protection circuit 130 may drive the power supply 400 by normally applying an enable signal EN having an on voltage to the power supply 400. The overcurrent protection circuit 130 may shut down the power supply 400 by applying an enable signal EN having an off voltage to the power supply 400.

The overcurrent protection circuit 130 increases the set current value when the global current GC of the black image is not greater than the first black set current value. The overcurrent protection circuit 130 initially sets the set current value corresponding to the screen load to the first set current value by using the lookup table of FIG. 2. The overcurrent protection circuit 130 may increase the set current value corresponding to the screen load from the first set current value to the second set current value by using the lookup table of FIG. 3. The overcurrent protection circuit 130 may increase the black set current value for the black image from the first black set current value to the second set black current value by using the lookup table of FIG. 5.

After the overcurrent protection circuit 130 increases the set current value from the first set current value to the second set current value, the display device may be driven again. That is, the display device displays an image on the display portion 600 according to or based on the input image signal.

Thereafter, when the global current GC that is greater than the second set current value is received, the black image is displayed again. The overcurrent protection circuit 130 compares the second set black current value with the global current GC of the black image. When the global current GC of the black image is greater than the second set black current value, the overcurrent protection circuit 130 shuts down the power supply 400. When the global current GC of the black image is not greater than the second set black current value, the overcurrent protection circuit 130 may increase the set current value corresponding to the screen load from the second set current value to the third set current value by using the lookup table of FIG. 4. The overcurrent protection circuit 130 may increase the black set current value for the black image from the second black set current value to the third set black current value by using the lookup table of FIG. 5.

After the overcurrent protection circuit 130 increases the set current value from the second set current value to the third set current value, the display device may be re-driven.

Thereafter, when the global current GC that is larger than the third set current value is received, the black image is again displayed. The overcurrent protection circuit 130 compares the third set black current value with the global current GC of the black image. When the global current GC of the black image is greater than the third set black current value, the overcurrent protection circuit 130 shuts down the power supply 400. When the global current GC of the black image is not greater than the third set black current value, the overcurrent protection circuit 130 determines whether or not the set current value may be increased. Since the set current value is no longer increased from the third set current value, the overcurrent protection circuit 130 shuts down the power supply 400.

As described above, the overcurrent protection circuit 130 prevents or reduces instances of the black image being repeatedly displayed on the display portion 600 by detecting whether or not the overcurrent flows in the display device while sequentially increasing the set current value. In addition, by setting the set current value of the overcurrent protection circuit 130 at a ratio (e.g., a set or predetermined ratio) with the global current value corresponding to the screen load, the overcurrent protection circuit 130 may adaptively operate with respect to the screen load, and may detect the overcurrent in a low screen load state.

Hereinafter, a driving method of the display device according to some example embodiments of the present invention will be described in more detail with reference to FIG. 6 along with FIG. 1 to FIG. 5 described above.

Figure 6:
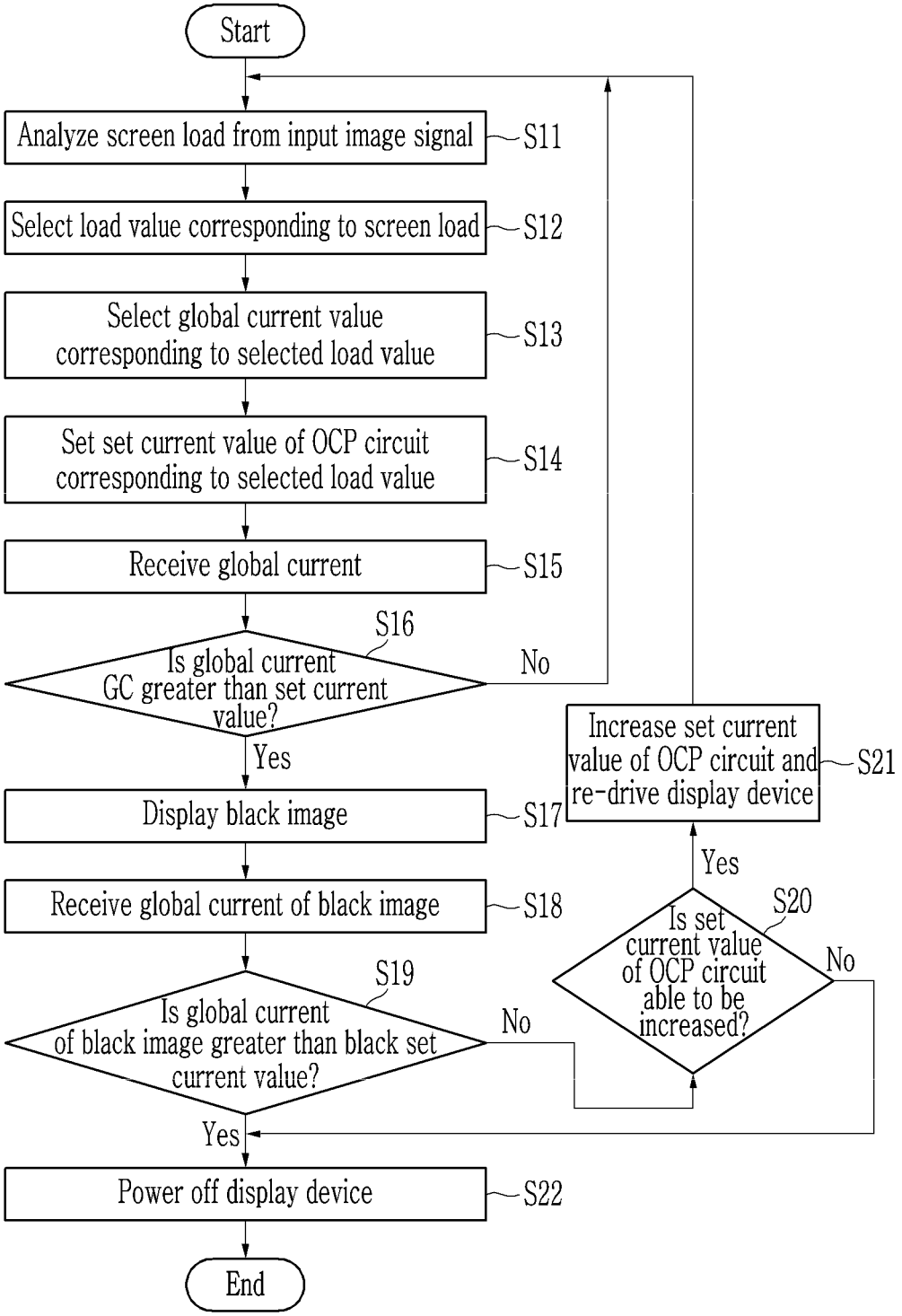
FIG. 6 illustrates a flowchart of a driving method of a display device according to some example embodiments of the present invention.

FIG. 6 illustrates a flowchart of a driving method of a display device according to some example embodiments of the present invention.

Referring to FIG. 6, the display device analyzes the screen load from the input image signal ImS (S11).

The display device selects the load value corresponding to the screen load (S12). As the screen load increases, the load value increases up to the reference load, and when the screen load is greater than or equal to the reference load, the load value may be set to the reference load.

The display device selects the global current value corresponding to the selected load value (S13). As the screen load increases to the reference load, the global current value increases, and when the screen load is greater than or equal to the reference load, the global current value may be set to the global current value corresponding to the reference load.

The display device sets the set current value of the overcurrent protection circuit 130 corresponding to the selected load value (S14). The display device may set the set current value by using the lookup tables of FIG. 2 to FIG. 4. The set current value of the overcurrent protection circuit 130 may be set at a ratio (e.g., a set or predetermined ratio) with respect to the selected global current value. When the selected global current value is 1 A or less, the set current value of the overcurrent protection circuit 130 may be set to a value (e.g., a set or predetermined value) instead of the ratio (e.g., the set or predetermined ratio) with respect to the selected global current value. The set current value is a criterion for determining whether or not the display device is powered off.

The display device receives the global current GC of the power voltages ELVDD and ELVSS supplied to the display portion 600 (S15).

The display device compares the global current GC with the set current value (S16).

When the global current GC is greater than the set current value, the display device displays the black image (S17). When the global current GC is greater than the set current value, the display device may generate the power line error signal PL, and display the black image according to the power line error signal PL.

The display device receives the global current of the black image (S18).

The display device compares the global current of the black image with the black set current value (S19). The black set current value for the black image may be set by using the lookup table of FIG. 5.

When the global current of the black image is greater than the black set current value, the display device is powered off (S22).

When the global current of the black image is not greater than the black set current value, the display device determines whether the set current value of the overcurrent protection circuit 130 may increase (S20). The display device initially sets the set current value of the overcurrent protection circuit 130 by using the lookup table of FIG. 2. As a process of displaying the black image is repeated because the global current is detected to be greater than the set current value, the display device may increase the set current value of the overcurrent protection circuit 130 from the first set current value of the lookup table of FIG. 2 to the second set current value of the lookup table of FIG. 3, or the display device may increase the set current value of the overcurrent protection circuit 130 from the second set current value of the lookup table of FIG. 3 to the third set current value of the lookup table of FIG. 4. That is, the set current value of the overcurrent protection circuit 130 may be set to a value that is 20% higher than the global current value, may increase to a value that is 25% higher than the global current value, and then, may increase to a value that is 30% higher than the global current value.

When the set current value of the overcurrent protection circuit 130 is able to increase, the display device increases the set current value of the overcurrent protection circuit 130, and it is re-driven (S21).

When the set current value of the overcurrent protection circuit 130 is not able to increase, the display device is powered off (S22). After the set current value of the overcurrent protection circuit 130 is increased to the third set current value, when the black image is displayed again, the set current value is no longer increased.

Hereinafter, an example of a pixel PX that may be included in the display device according to some example embodiments of the present invention will be described with reference to FIG. 7.

Figure 7:
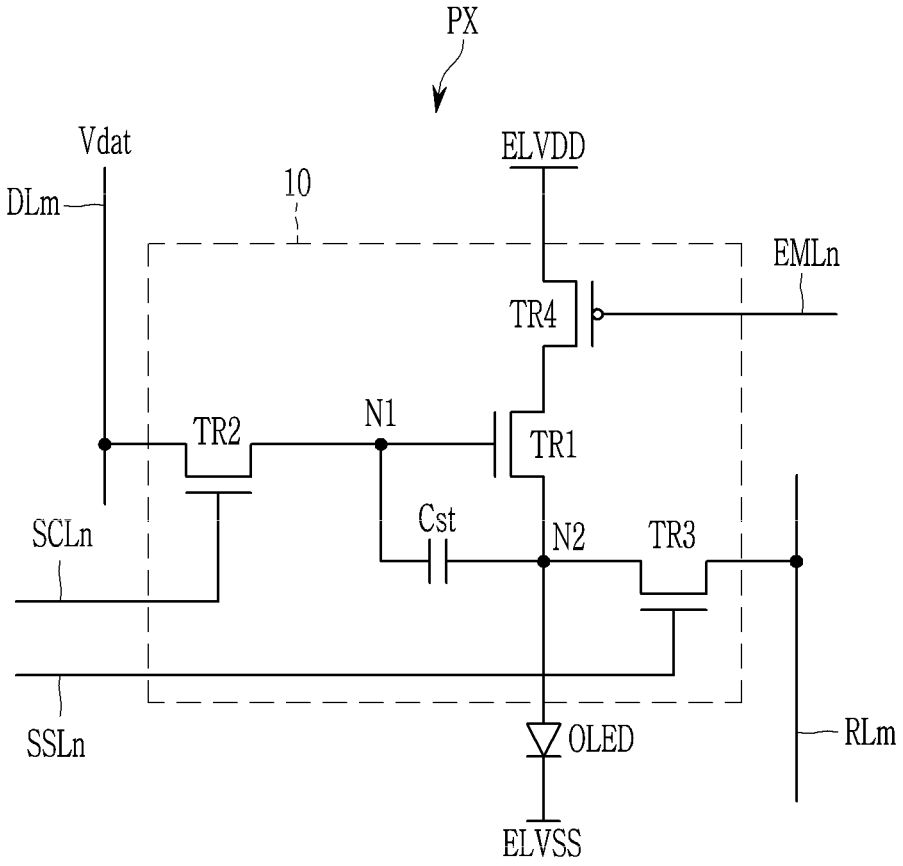
FIG. 7 illustrates a circuit diagram of a pixel according to some example embodiments of the present invention.

FIG. 7 illustrates a circuit diagram of a pixel according to some example embodiments of the present invention. A pixel PX positioned in an n-th pixel row and an m-th pixel column among the plurality of pixels PX included in the display device of FIG. 1 will be described as an example.

Referring to FIG. 7, the pixel PX includes an organic light emitting diode OLED and a pixel circuit 10.

The pixel circuit part 10 is configured to control a current flowing from the first power voltage ELVDD to the organic light emitting diode OLED. The pixel circuit 10 may include a driving transistor TR1, a switching transistor TR2, a sensing transistor TR3, a light emitting transistor TR4, and a storage capacitor Cst.

The driving transistor TR1 includes a gate electrode connected to a first node N1, a first electrode to which the first power voltage ELVDD is applied through the light emitting transistor TR4, and a second electrode connected to a second node N2. The driving transistor TR1 is connected between the first power voltage ELVDD and the organic light emitting diode OLED, and corresponds to a voltage of the first node N1 to control an amount of current flowing from the first power voltage ELVDD to the organic light emitting diode OLED.

The switching transistor TR2 includes a gate electrode connected to the scan line SCLn, a first electrode connected to the data line DLm, and a second electrode connected to the first node N1. The switching transistor TR2 is connected between the data line DLm and the driving transistor TR1, and is turned on by a scan signal of the gate-on voltage applied to the scan line SCLn to transmit the data voltage Vdat applied to the data line DLm to the first node N1.

The sensing transistor TR3 includes a gate electrode connected to the sensing line SSLn, a first electrode connected to the second node N2, and a second electrode connected to the receiving line RLm. The sensing transistor TR3 is connected between the second electrode of the driving transistor TR1 and the receiving line RLm, and it is turned on by a sensing signal of a gate-on voltage applied to the sensing line SSLn to transmit the current flowing to the organic light emitting diode OLED through the driving transistor TR1 to the receiving line RLm. Meanwhile, the receiving line RLm may be used as a wire for transmitting an initialization voltage to the second node N2. As the initialization voltage is applied to the second node N2 through the receiving line RLm, the anode voltage of the organic light emitting diode OLED may be initialized.

The light emitting transistor TR4 includes a gate electrode connected to the light emitting line EMLn, a first electrode to which the first power voltage ELVDD is applied, and a second electrode connected to the first electrode of the driving transistor TR1. The light emitting transistor TR4 is turned on by the light emitting signal of the gate-on voltage applied to the light emitting line EMLn to transmit the first power voltage ELVDD to the driving transistor TR1.

The driving transistor TR1, the switching transistor TR2, and the sensing transistor TR3 may be n-channel field effect transistors, and the light emitting transistor TR4 may be a p-channel field effect transistor. The gate-on voltage for turning on the n-channel field effect transistor is a high level voltage, and the gate-off voltage for turning it off is a low level voltage. The gate-on voltage for turning on the p-channel field effect transistor is a low level voltage, and the gate-off voltage for turning it off is a high level voltage. In some embodiments, at least one of the driving transistor TR1, the switching transistor TR2, and the sensing transistor TR3 may be a p-channel field effect transistor, and the light emitting transistor TR4 may be an n-channel field effect transistor.

The storage capacitor Cst includes a first electrode connected to the first node N1 and a second electrode connected to the second node N2. The data voltage Vdat is transmitted to the first node N1, and the storage capacitor Cst maintains the voltage of the first node N1.

The organic light emitting diode OLED includes an anode connected to the second node N2, and a cathode to which the second power voltage ELVSS is applied. The organic light emitting diode OLED may emit light at a luminance corresponding to a current supplied from the pixel circuit 10. The organic light emitting diode OLED may emit light of one of primary colors or white light. Examples of the primary colors may include three primary colors such as red, green, and blue. Another example of the primary colors may include three primary colors such as yellow, cyan, and magenta.

While this invention has been described in connection with what is presently considered to be practical embodiments, it is to be understood that the invention is not limited to the example embodiments, but, on the contrary, is intended to cover various modifications and equivalent arrangements included within the spirit and scope of the appended claims and their equivalents. Therefore, those skilled in the art will understand that various modifications and other equivalent embodiments of the present invention are possible. Consequently, the true technical protective scope of the present invention must be determined based on the technical spirit of the appended claims and their equivalents.

What is claimed is:

1. A display device comprising:

a net power control circuit configured to analyze a screen load from an input image signal to generate a load signal including a load value corresponding to the screen load; and an overcurrent protection circuit configured to set a set current value at a predetermined ratio with respect to a global current value corresponding to the load value included in the load signal, and to determine whether or not the display device is powered off based on the set current value, wherein the overcurrent protection circuit is configured to set the set current value to a predetermine value rather than the predetermined ratio with respect to the global current value, in response to the global current value being less than a threshold value.

2. The display device of claim 1, wherein the overcurrent protection circuit is configured to set the set current value to the predetermined value rather than at the predetermined ratio with respect to the global current value in response to the global current value being 1 A or less.

3. The display device of claim 1, wherein:

the load value increases as the screen load increases up to a reference load, and in response to the screen load being the reference load or more, the load value is set to the reference load; and the global current value increases as the screen load increases up to the reference load, and in response to the screen load being the reference load or more, the global current value is set to the global current value corresponding to the reference load.

4. The display device of claim 1, further comprising a global current modulation circuit configured to select the global current value corresponding to the load value included in the load signal, and to generate a global current signal including a difference between a global current of a power voltage supplied to a display portion and the global current value.

5. The display device of claim 4, further comprising:

a plurality of pixels in the display portion;

a power supply configured to supply a power voltage for driving the plurality of pixels to the display portion;

a data driver configured to apply a data voltage to the plurality of pixels; and a signal controller configured to receive the input image signal, to generate an image data signal by applying the load value and the global current value to the input image signal, and to apply the image data signal to the data driver.

6. The display device of claim 5, wherein:

the overcurrent protection circuit is configured to receive a global current of a power voltage supplied to the display portion, and to generate a power line error signal in response to the global current being greater than the set current value; and the signal controller is configured to control the data driver to display a black image on the display portion in response to the power line error signal being received.

7. The display device of claim 6, wherein the overcurrent protection circuit is configured to receive a global current of the black image in response to the black image being displayed on the display portion, and to shut down the power supply in response to the global current of the black image being greater than a black set current value.

8. The display device of claim 6, wherein the overcurrent protection circuit is configured to set the set current value to one of a first set current value that is 20% higher than the global current value, a second set current value that is 25% higher than the global current value, and a third set current value that is 30% higher than the global current value.

9. The display device of claim 8, wherein in response to the black image being displayed on the display portion, the overcurrent protection circuit receives the global current of the black image, and in response to the global current of the black image not being greater than a black set current value, the overcurrent protection circuit increases the set current value to the second set current value or the third set current value.

10. The display device of claim 9, wherein the overcurrent protection circuit is configured to shut down the power supply in response to the set current value not being increased.

11. A driving method of a display device, comprising:

analyzing a screen load from an input image signal;

selecting a load value corresponding to the screen load;

selecting a global current value corresponding to the selected load value;

setting a set current value of an overcurrent protection circuit corresponding to the selected load value, wherein whether the display device is powered off is determined based on the set current value; and in response to the selected global current value being below a threshold, setting the set current value of the overcurrent protection circuit to a predetermined value.

12. The driving method of the display device of claim 11, further comprising setting the set current value of the overcurrent protection circuit at a predetermined ratio with respect to the selected global current value.

13. The driving method of the display device of claim 12, wherein the set current value of the overcurrent protection circuit is set to a value that is in a range of 20% to 30% higher than the selected global current value.

14. The driving method of the display device of claim 12, wherein in response to the selected global current value being 1 A or less, the set current value of the overcurrent protection circuit is set to a predetermined value rather than a predetermined ratio with respect to the selected global current value.

15. The driving method of the display device of claim 11, wherein:

the load value increases as the screen load increases up to a reference load, and in response to the screen load being equal to or greater than the reference load, the load value is set to the reference load; and the global current value increases as the screen load increases up to the reference load, and in response to the screen load being greater than or equal to the reference load, the global current value is set to the global current value corresponding to the reference load.

16. The driving method of the display device of claim 11, further comprising:

receiving the global current value;

comparing the global current value with the set current value; and displaying a black image in response to the global current value being greater than the set current value.

17. The driving method of the display device of claim 16, further comprising:

receiving a global current of the black image;

comparing the global current of the black image with a black set current value; and powering off the display device in response to the global current of the black image being greater than the black set current value.

18. The driving method of the display device of claim 17, further comprising:

determining whether the set current value of the overcurrent protection circuit is able to be increased in response to the global current of the black image not being greater than the black set current value; and in response to the set current value of the overcurrent protection circuit being able to be increased, increasing the set current value of the overcurrent protection circuit and re-driving the display device.

19. The driving method of the display device of claim 18, wherein the set current value of the overcurrent protection circuit is set to a value that is 20% higher than the global current value, and increases to a value that is 25% higher than the global current value or to a value that is 30% higher than the global current value.

20. The driving method of the display device of claim 18, further comprising:

powering off the display device in response to the set current value of the overcurrent protection circuit not being able to be increased.

* * * * *